United States Patent [19]

Meyer

[11] Patent Number: 4,884,967

[45] Date of Patent: Dec. 5, 1989

[54] STEEL REHEATING FURNACE

[75] Inventor: Robert W. Meyer, Novi, Mich.

[73] Assignee: Combustion Concepts, Inc., Detroit, Mich.

[21] Appl. No.: 249,503

[22] Filed: Sep. 26, 1988

[51] Int. Cl.[4] ..... F27D 3/04

[52] U.S. Cl. ..... 432/127; 432/234; 432/146; 432/249

[58] Field of Search ..... 432/234, 126, 127, 146, 432/249

[56] References Cited

U.S. PATENT DOCUMENTS

| | | | |
|---|---|---|---|
| 3,161,406 | 12/1964 | Saydam | 432/146 |
| 3,291,465 | 12/1966 | Wilde | 432/146 |
| 3,342,468 | 9/1967 | Sidwell | 432/127 |
| 3,383,098 | 5/1968 | O'Reilly et al. | 263/6 |
| 3,387,834 | 6/1968 | Bricmont et al. | 263/6 |
| 3,637,198 | 1/1972 | Knaak | 432/234 |
| 3,642,261 | 2/1972 | Laws | 432/234 |
| 3,664,649 | 5/1972 | Brockmann | 263/6 A |
| 3,806,309 | 4/1974 | Laws et al. | 432/126 |
| 3,851,091 | 11/1974 | Laws et al. | 432/127 |
| 4,056,351 | 11/1977 | Knaak | 432/234 |
| 4,293,299 | 10/1981 | Gaddes | 432/234 |
| 4,354,824 | 10/1982 | Campbell, Jr. | 432/3 |
| 4,582,483 | 4/1986 | Brand | 432/127 |
| 4,604,056 | 8/1986 | Jones | 432/249 |
| 4,689,009 | 8/1987 | Heuss | 432/234 |

OTHER PUBLICATIONS

"Productivity Improvements Steel Slab Reheat Furnaces".

*Primary Examiner*—Henry C. Yuen

*Attorney, Agent, or Firm*—Harness, Dickey & Pierce

[57] ABSTRACT

A steel reheating furnace is characterized by a plurality of elongated, longitudinally extending, heating elements and associated skid rails, the skid rails having primary portions laterally offset with the portions supporting respective of laterally offset first and second areas on the bottom of slabs as they pass through the furnace. The heating elements direct their heat at the respective first areas when the slabs have their second areas supported by the rail portions, and vice versa, whereby to eliminate skid marks caused by the rail portions shielding the slab.

23 Claims, 3 Drawing Sheets

STEEL REHEATING FURNACE

BACKGROUND AND SUMMARY OF THE INVENTION

This invention relates to a steel reheating furnace, such as a slab reheating pusher furnace and/or a walking beam furnace, and in particular to a furnace including a soak zone in which the slabs are actively heated from below to eliminate skid marks.

Reheating furnaces are used to raise the temperature of steel ingots, billets, slabs and the like in the course of processing until they are sufficiently hot to be economical for reduction by rolling, forging or drawing into a desired section. In one continuous-type of reheating furnace, the workpieces are pushed through the furnace on skid rails and heat is applied above and below the workpiece such that the workpieces are heated to rolling temperature. The skid rails locally restrict heat that would otherwise fall on the workpiece, thereby causing a temperature differential in the material which is sometimes visually identifiable on discharge and termed a skid mark. Importantly, rolled steel uniformity is adversely affected by temperature differentials such that extended processing of the workpieces may be necessary to eliminate differences in material.

If the material in the vicinity of the skid mark is not hot enough at discharge, the forces needed to complete deformation of the material during a rolling operating may exceed the rolling forces that the roll mechanism can supply and system damage may result. Even if the steel is sufficiently hot to allow successful rolling, the load seen by the rolls may vary significantly during rolling, requiring a control system when metal thickness or "gauge" control is important. However, because much of the steel rolled to strip is supplied under minimum gauge requirements, rolling mill controls are frequently set up to maintain this minimum gauge condition, resulting in overgauge conditions in the vicinity of the skid mark. This is a material loss to the operation in that excess material will be shipped.

U.S. Pat. No. 3,642,261 discloses a skid rail having support portions laterally offset relative to a vertical plane through the rail. Early efforts to improve steel quality resulted in a change from uninsulated water cooled rails to insulated rails. The lower temperature of the uninsulated skid rail was a heat sink and resulted in a heat loss. The insulated rail increased the temperature of the rail surface but also increased the outer dimensions of the support system and thus increased radiative shading. It is believed that rail surface temperature is not as significant in skid mark generation as the shielding of the slab from furnace radiation. The mechanism of heat transfer in the vicinity of the rail includes direct radiation from the furnace wall and flame or products of combustion, radiation interchange with the support, diffusion within the slab and some small amount of conduction. The reheating process is sensitive to additional furnace residence time needed for reducing or minimizing temperature gradients due to reduced heat transfer in the vicinity of the skids.

It is an object of this invention to provide a reheating furnace which reduces or eliminates the cooler regions in the slabs known as skid marks.

Another object of this invention is establishment of a concentrated energy flow in the vicinity of the skid support system by provision of active preferential heating, prior to discharge.

A further object of this invention is provision of a furnace heating system which reduces the required residence time in a reheat furnace by reducing thermal gradients formed during processing through the use of active heating elements.

Yet a further object of this invention is provision of pressurized heating means which significantly improves the convective mode of heat transfer.

Another object of this invention is provision of a pressurized heating means which may be used to enhance the radiative heat transfer mode.

In accordance with this invention, there is provided a furnace having a chamber for heating workpieces which are to be advanced through the furnace from an inlet and delivered to an outlet. In particular, the chamber comprises a soak zone adjacent to the outlet, means for supporting the workpieces including a plurality of laterally spaced, longitudinally extending, support rails, each rail having a first and second portion for supporting first and second areas on the workpieces with each first portion being laterally offset to its second portion and proximate to the outlet, and heating means in the soak zone for actively heating the workpieces, including a plurality of longitudinally extending first heating elements for directing heat at the second areas only when the first areas are supported by the first portions. Generally, the rails and the heating elements are disposed, respectively, in parallel planes, the elements being superposed by the respective skid marks previously formed by the rail second portions engaging the second areas on the workpieces, immediately prior to the workpieces being pushed on to the first portions. The heating elements are longitudinally apertured and direct heating gases at the first areas, each element either being supplied by a compressed gas/air mixture external to the furnace and combusted therewithin, or supplied under pressure and combusted within the furnace as a result of the elevated temperatures provided in the soak zone.

In another embodiment according to this invention, each rail includes a third portion which is proximate to the inlet and axially aligned with the first portion proximate the outlet, the second portion being intermediate and laterally offset to the first and third portions, the respective aligned first and third portions supportingly engaging the first areas on the slab bottom and second portions supportingly engaging the second areas on the slab bottom. Advantageously, this can be extended to a fourth, fifth portion, etc.

Heating means for actively preferentially heating the slabs are disposed in a horizontal plane vertically below the rails and include the above-stated first heater elements, associated with the first portions, and a like array of second heater elements that are associated with the second portions. The second heater elements are superposed by the respective skid marks previously formed by the rail third portions engaging the first areas, immediately prior to the workpieces being pushed on to the second portions. The first heater elements generally prevent skid marks from building up in the second areas when the second areas were supported by the second portion. The second heater elements eliminate skid marks from the first areas from when the first areas were supported by the third portions.

Advantageously a furnace arrangement that preferentially heats the workpieces reduces or eliminates thermal differentials which could damage rollers and/or contribute to overgauge conditions.

Localized heating can provide for a reduction in the length of the soak hearth and pressurized combustion provides enhanced heat transfer, such as high rates of convection. A higher thermal head (through higher flame temperature) may be utilized to achieve increased radiative heat transfer.

Suitably offsetting active heating members relative to the skid rails will obviate accumulation of scale and skid marks.

Reduced residence time in the furnace has the potential of increasing fuel economy and decreasing scale loss.

Additional objects and advantages of the present invention will become apparent from reading the detailed description of the preferred embodiments which makes reference to the following set of drawings.

DETAILED DESCRIPTION OF THE PREFERRED EMBODIMENT

Figure 1:
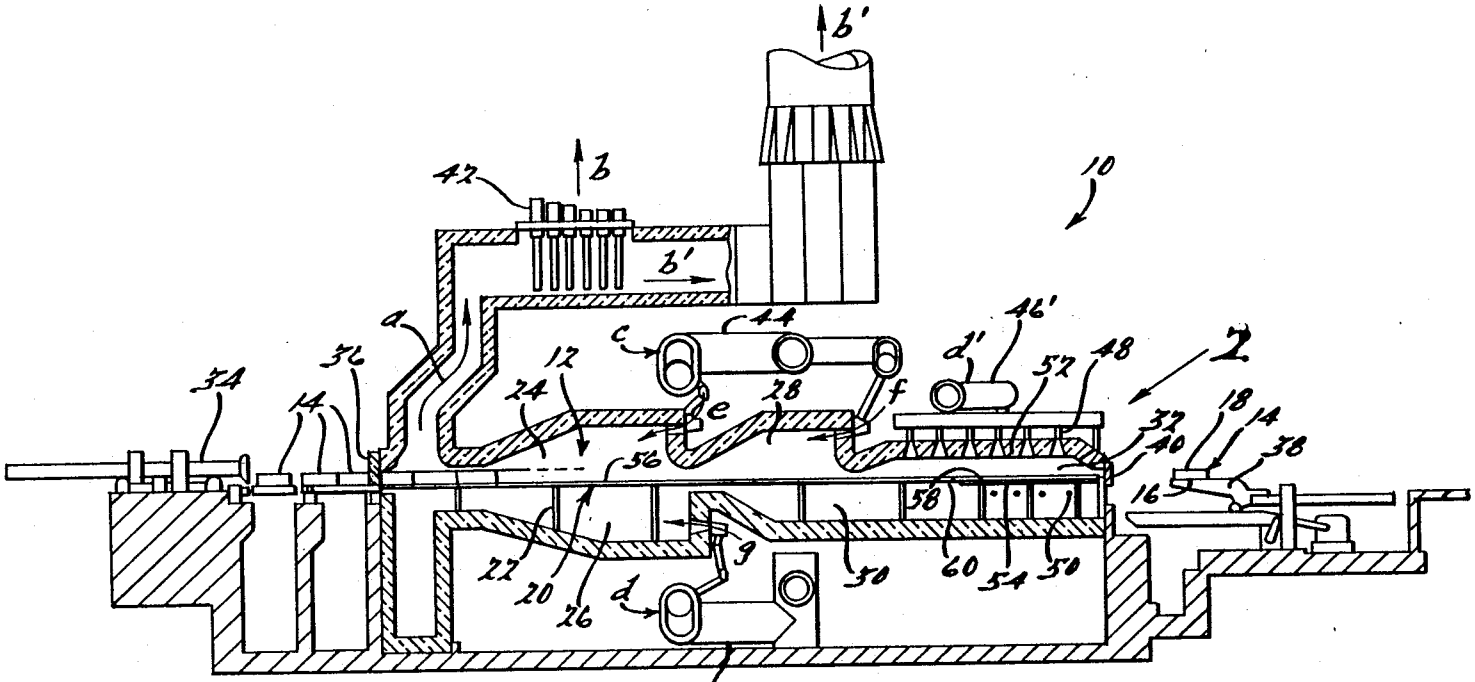
FIG. 1 is a side elevation view, in section, of a reheating furnace for passing workpieces and having a soak zone.

Turning now to the drawings, FIG. 1 shows a pusher-type reheating furnace 10 of the continuous type, although the invention will equally apply to a walking beam-type of furnace. The pusher furnace comprises an elongated chamber 12 having five heating zones, through which workpieces such as steel slabs 14 are to be fed in a feeding direction, each slab being generally oblong shaped including a bottom surface 16 supported on an array of elongated support rails 20 and a top surface 18. The skid rails are appropriately supported through the chamber by standoffs 22 whereby to define a horizontal pass line for the workpieces.

The five zones of the chamber are as follows: a top fired preheat zone 24, a bottom fired preheat zone 26, a top fired heating zone 28, a bottom fired heating zone 30, and a soak zone 32 top and bottom fired to overcome heat loss from the zone. A pusher 34 pushes slabs through an inlet door 36 into the preheat zones of the furnace and an ejector 38 extracts the heated slabs from an outlet door 40 adjacent to the soak zone. The slabs are stepwise continuously transported through the zones by pushing slabs one against the other over the support rails, each rail extending longitudinally throughout the furnace length.

Products of combustion are passed along path "a" to a preheater manifold 42 and passed therefrom along path "b'" to be exhausted. Combustion air is passed along path "b" to be preheated and then injected along with fuel gas at low pressure along paths "c", "d" and "d'", respectively, into air manifolds 44, 46 and 46'. Combustion occurs in the top preheat zone and top heat zone along paths "e" and "f", respectively, and into the bottom preheat zone along path "g". In the soak zone, burners 48 and 50 are adjacent the outlet door, burners 48 developing a generally flat flame about the roof 52 of the chamber primarily to cover furnace losses and maintain heat in the top surface 18 of the workpieces 14.

In accordance with this invention, pressurized preferential heating elements 54 are associated with each skid rail 20, each heating element being adjacent the outlet door 40 to develop a desired temperature by directing heated combustion gases at the bottom surface 16 of the workpiece. In a preferred embodiment, the rail has two primary portions 56 and 58 laterally offset by a transition portion 60, each primary portion being elongated and longitudinally extending. When the slabs are in the preheat and heat zones, the first primary portion 56 of each rail supports each successive slab in a respective first area 62 on the bottom surface of the slab. Because of this, heat energy is shielded from reaching the slab in the region engagingly supported by the rail. When the slabs are pushed into the soak zone, the second primary portion 58 of each rail supports each successive slab in a respective second area 64 of the bottom surfaces. The heating elements direct heat at the now exposed first areas 62. The first and second areas 62 and 64 would be, for the rails shown, longitudinally extending.

Figure 2:
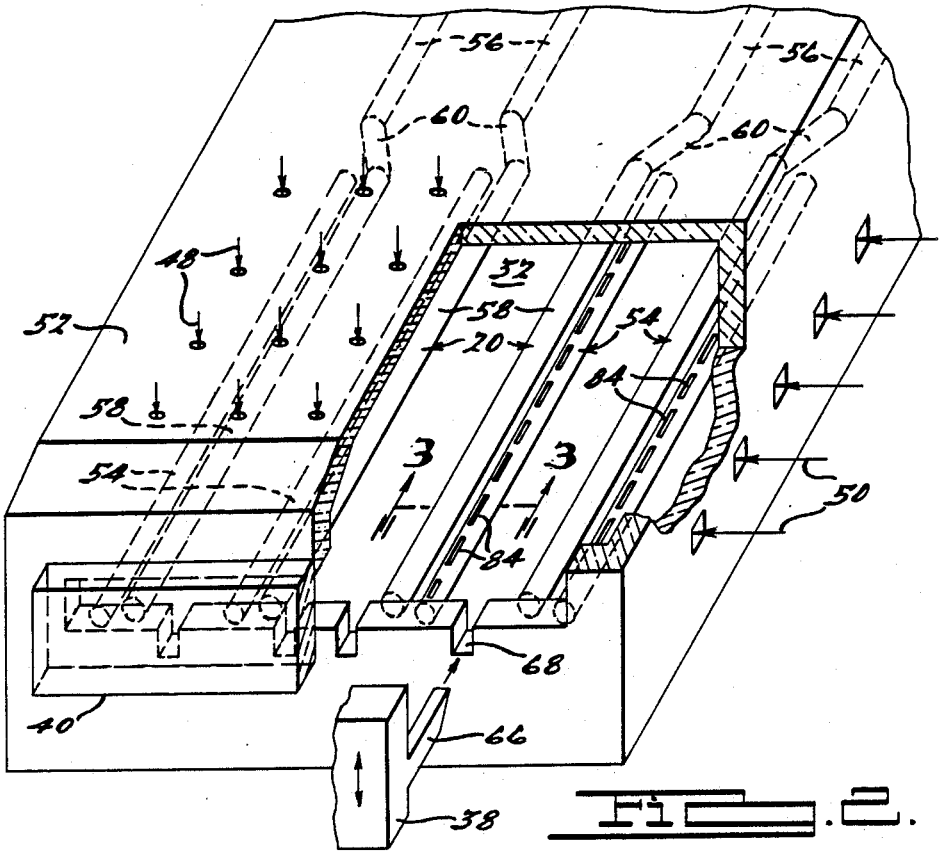
FIG. 2 is a perspective view of the soak zone shown in FIG. 1.

FIG. 2 shows soak zone 32, discharge outlet door 40, the arrangement for extracting slabs 14 (as shown in FIG. 1) from the soak zone, burners 48 located in the roof to direct heat at the top surface of the slab to maintain slab temperature, and burners 50 extending along the sides of the furnace to generally direct heat at the side and bottom surfaces of the slab. For the purposes of illustration, four elongated skid rails 20 are provided each in the same horizontal plane and in side-by-side relation. The ejector 38 is adapted to move longitudinally so as to thrust an arm 66 through a keyway 68 leading into the soak chamber, whereupon the arm will engage a slab, and move vertically so as to lift the slab from the skid rails. Rearward longitudinal movement extracts the slabs from the furnace for further processing.

The skid rails 20 comprise a generally tubular member 70 that has a central axis and a flat 71 extending the length of the rail, the axes of the rail portions 56, 58 and 60 being in a common horizontal plane. While tubular member 70 is shown as having a cross section that is circular, it could be other (e.g., rectangular, trapezoidal, etc.). Shown in FIG. 3 a longitudinally extending, generally planar, rider bar 72 extends upwardly from each flat 71 for supporting the workpieces with each bar being disposed in a radial vertical plane passing through the axis of its tube and defining a horizontal support surface 74 adapted to engage the bottom surface of the workpieces as they are moved through the furnace. Rider bar 72 could also be laterally offset from a vertical plane passing through the rail axis. The bottom of workpieces 14 are thus spaced from flat 71 to enhance radiative heat transfer in the vicinity of the skid mark. While bar 72 is shown as being continuous, it could comprise a series of axially separated, spaced apart "buttons" such as found in a walking beam-type furnace. Centrally of each skid rail 20 is a chamber 76 for flow of cooling media. The exterior of the rail may be protected by a refractory member 78. A dense refractory abrasion resistant material 79 fills in the space between bar 72 and flat 71 to protect refractory material 78.

In accordance with this invention, to eliminate the presence of thermal gradients in the workpieces, caused by the first portions of the skid rails shielding the bottom surface of the workpieces, a plurality of heating elements 54 are positioned in a horizontal plane, shown in FIG. 3 as being in a horizontal plane below the second portions 58 of the skid rails 20, one heating element 54 for each skid rail and each heating element 54 preferably oriented such that its axis and the axis passing through the first portion 56 of its associated skid rail are generally in the same vertical plane. Each heating element 54 comprises a generally tubular pipe 80 that has an inner chamber 82 and extends an amount defined by the length of its offset second portion with slots 84 in the respective heating element 54 extending longitudinally and directing heat vertically upward at the axis of the rail. Each heating element 54 is provided with a row of slots and can be internally cooled (not shown), the slots being arranged along a longitudinal line and each extending radially into the chamber of the heating element.

When a slab 14 is in a first position such as in the preheat and heat zones 24, 26, 28 and 30, the first portions 56 of the skid rails 20 have their bars 72 engaging respective first surface areas 62 on the bottom surface 16 of the slab. Heat blocked by the skid rail first portions cause "skid marks" that are laterally spaced, and longitudinally extending. As the slab continues through the chamber zones to a second position, such as in the soak chamber 32, the second portions 58 of the support rails are engaging second surface areas 64 on the bottom surface of the slab. Importantly, on the slabs, the previously supported first areas 62 are now exposed, and the second areas 64 are supported by the first portions. The heating elements are positioned to heat the first areas 62 when the skid rails have their second portions 58 supporting the second areas 64.

Figure 3:
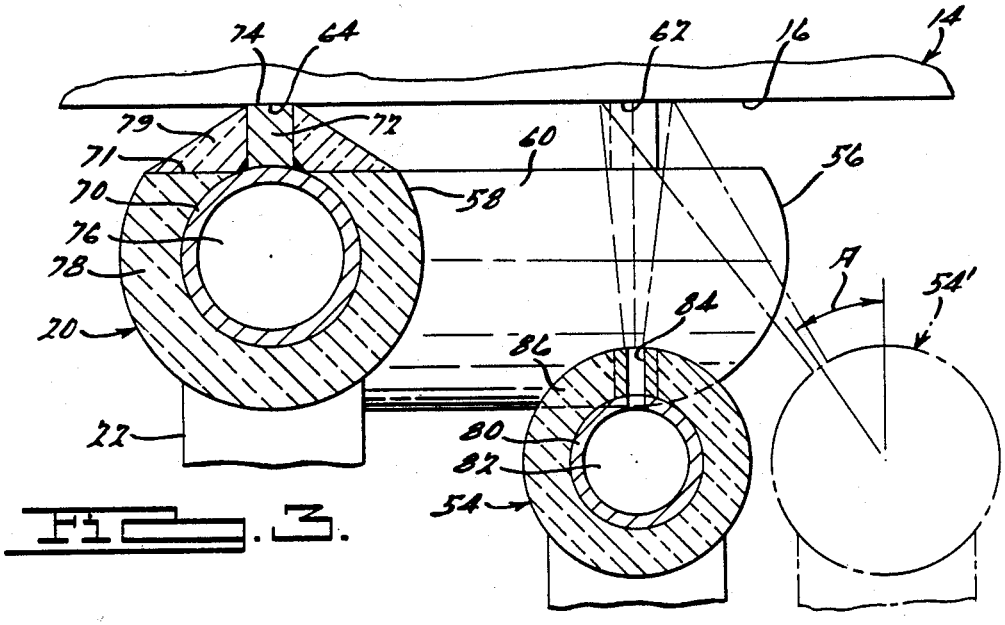
FIG. 3 is an end view, in section, of a workpiece support arrangement in the soak zone wherein top surfaces of skid rails engage the bottom surfaces of the workpieces and pressurized heating elements positioned for actively heating selected areas on the bottom surfaces.

FIG. 3 shows a skid rail 20 and its associated bar 72 in overlying relation with a heating element 54. Heating element 54 has an outer refractory member 86, inner pipe 80 comprised of steel, and a slot 84 for directing heat at the bottom surface of the slab. The skid rail second portion 58 is laterally offset from its first portion 56 such that the heat from the heating element is focused at that position supported by the first portion when the slab was pushed through the preheat and heat zones of the furnace. The heating element 54'(shown in phantom) indicates a situation wherein the combusted gases are focused at the skid mark at an angle "A" to a vertical plane passing through the heating element. It is to be appreciated that more than one row of slots could be provided for directing multiple heated gas streams at the bottom of the slab.

In one arrangement the skid rail 20 generally has an outside diameter of 10–14 inches, rider bar 72 extends vertically about 1 to 1½, and the heating elements 54 are in a horizontal plane about 3–7 inches below the slab plane. The heating element 54 directs pressurized combustion gases at the slabs 14. Depending on the application the interior pressure of the air and gas mix would be 2–300 psi gauge and the exterior pressure is atmospheric (i.e., about zero gauge). The heating element can receive products of combustion from the mixture of fuel and air and combusted externally of the furnace chamber. Further, the fuel and air could be mixed internally and combusted automatically upon being discharged from the slots, such combustion (or ignition) resulting from the soak zone being heated to the combustion temperature of the gas mixture.

Further, depending on the gas temperature of the combusted gas, the heating element could be comprised of several concentric annuli, some of steel and some of a refractory material such as SiC, with an intermediate annulus being cooled, such as by water. Details of a water cooled heating element, such as the skid rail, are not shown as being conventional.

Figure 4:
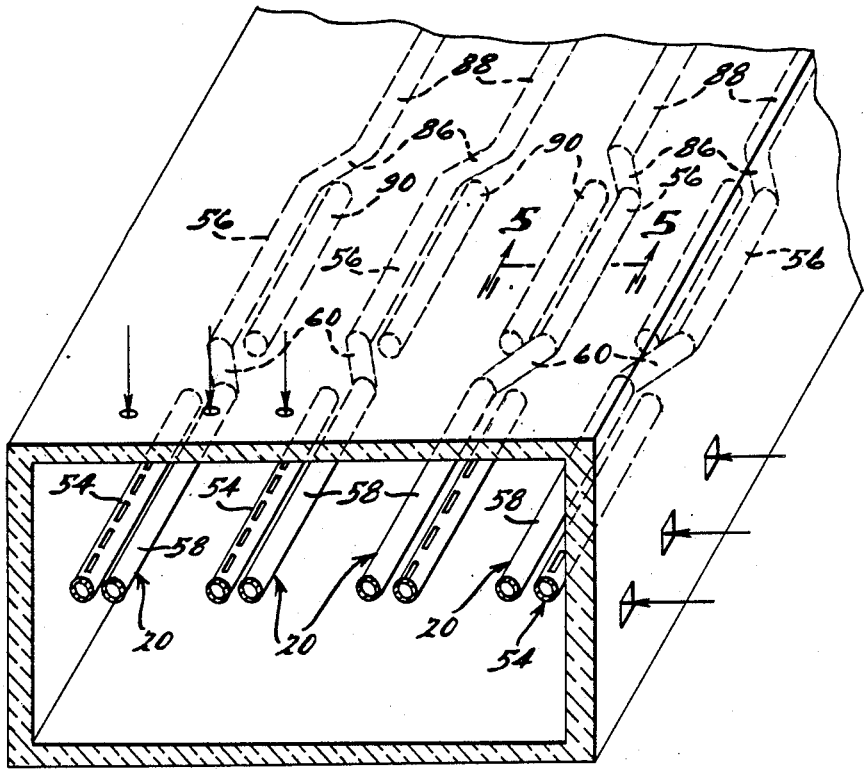
FIG. 4 is a perspcetive view of a reheating furnace including an alternate arrangement for preferentially heating the workpieces.
Figure 5:
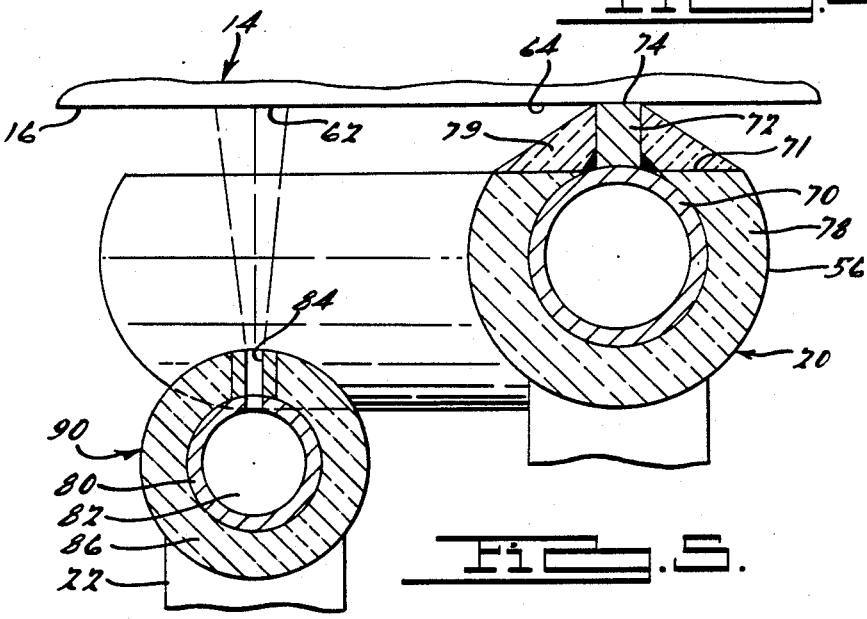
FIG. 5 is an end view taken along line 5—5 of FIG. 4.

FIG. 4 shows the reheating furnace being provided with an alternate arrangement for preferentially heating the workpieces whereby to eliminate the formation of cooler regions (i.e., skidmarks) and to reduce residence time of the workpieces in the furnace. As shown before in FIG. 2, skid rails 20 have laterally offset portions 56 and 58 and the transition portion 60, and heating elements 54 positioned proximate the outlet end of the furnace.

In accordance with this embodiment of the invention, skid rail 20 includes a second transition portion 86 and a third primary portion 88, and a second preferential heating element 90 is associated, respectively, with each primary portion 56. Primary portion 88, proximate the inlet end of the furnace, is generally coplanar with skid rail portions 56, 58, 60 and 86 and has its central axis generally coaxially aligned with its respective primary portion 58. Preferential heating elements 90 are generally coplanar with themselves and with heating elements 54, the heating elements being disposed in a horizontal plane vertically below the skid rails. Heating elements 90 generally prevent skid marks that may have been formed when the slabs were supported by the skid rail portions 88. Heating elements 54, proximate the outlet end of the furnace, generally eliminate skid marks that may have been formed when the slabs were supported by the intermediate portions 56.

Each rail portion successively supports a first and second area 62 and 64 on the bottom of the slab 14 as it passes through the furnace, possibly in first, second and third zones or areas in a zone thereof. Generally, one heating element 54 and 90 is associated with each rail 20, the heating element 90 being associated with rail portion 88 and in a common vertical plane passing through rail portions 58 and 88 thereof, and the heating element 54 being in a common vertical plane with the associated rail portion 56, the vertical planes being laterally spaced and generally perpendicular to the horizontal planes including, respectively, the rails and heating elements. Preferential heating elements 90 direct their heat at the first areas 62 when the slabs have their second areas 64 supported by the second portions 56 and preferential heating elements 54 direct their heat at the second areas 64 when the first areas 62 are supported by the first portions 58, whereby to eliminate skid marks caused by the third portions when the slab was in one furnace area and by the second portions when the slab was in the next furnace area.

As will be appreciated by those skilled in the art, the invention described herein can be extended to include a fourth and fifth portion, etc.

While the above description constitutes the preferred embodiment of the invention, it will be appreciated that the invention is susceptible to modification, variation, and change without departing from the proper scope or fair meaning of the accompanying claims.

What I claim is:

1. In a furnace for heating a workpiece which is to be advanced through the furnace from an inlet and delivered to an outlet, the improvement comprising support means including a pair of elongated rails for supporting the bottom surface of said workpiece, each rail extending longitudinally and having a first portion laterally offset from a second portion thereof, the respective first and second portions of each said rail supporting a respective first and second area defined on the bottom surface of said workpiece, and heating means for actively heating the second areas on said bottom surface, when the first areas are supported by the first portions.

2. The furnace as recited in claim 1, said heating means including a pair of longitudinally extending heating elements, each heating element being associated, respectively, with one and the other said rail and having separate means for directing heat at the second areas of the slab associated therewith when the slab has its first areas supported by the first portions.

3. The furnace as recited in claim 2, wherein the heating elements and the rails are disposed in respective horizontal planes with a vertical plane through the axis of each respective heating element passing through the first portion of its associated skid rail.

4. The furnace as recited in claim 1 wherein said first portions are proximate to the outlet and said second portions are proximate to the inlet.

5. The furnace as recited in claim 1 wherein each said second portion extends approximately 80% of the length of said rail.

6. The furnace as recited in claim 1 wherein each said rail includes a third portion generally axially aligned with its first portion such that each respective second portion is laterally offset from and forms a transition between its first and third portions.

7. The furnace as recited in claim 6 wherein said heating means includes means for actively heating said first areas when the second areas are supported on said second portions.

8. The furnace as recited in claim 2 wherein said heating element comprises an elongated tubular pipe having a central bore for receiving a combustible mixture of gas and air and apertures extending radially through the wall of the pipe, the apertures being adapted to direct combusted heating gases at the first areas on said slab.

9. The furnace as recited in claim 8 wherein said apertures are generally rectangular in shape and disposed along a common line.

10. The furnace as recited in claim 8 wherein the slots are disposed in a plane that passes through the axis defining said bore, said plane at an acute angle to a vertical plane passing through the axis.

11. The furnace as recited in claim 2, wherein said heating element comprises a series of generally concentric tubes including a central tube consisting of a refractory-type material for receiving a combustible mixture of gas and air, an outer sleeve, and means including a central annulus receiving a coolant for cooling the heating element.

12. The furnace as recited in claim 1 wherein the second portion of each said rail and its associated heating element are generally in the same vertical plane.

13. The furnace as recited in claim 1 wherein said rail includes a generally continuous support bar projecting therefrom and extending the length thereof for supporting the workpieces which ride thereupon.

14. The furnace as recited in claim 13 wherein said rail is generally cylindrical and said support bar extends radially relative to the rail axis.

15. The furnace as recited in claim 14 wherein the support bar is generally planar and is in a vertical plane passing through the rail axis, the bar having a top surface defining a horizontal plane for supporting the slabs.

16. The furnace as recited in claim 1 wherein said rail is generally cylindrical and includes a generally continuous support bar depending therefrom and extending the length thereof for supporting the workpieces which ride thereupon, said bar being in a generally vertical plane laterally offset from a vertical plane passing through the rail axis.

17. The furnace as recited in claim 1 wherein said rail includes a plurality of axially spaced buttons extending radially therefrom for supporting the workpieces which ride thereupon, the buttons being in a vertical plane passing through its axis and having a top surface defining a horizontal plane for supporting the slabs.

18. A furnace for heating a steel slab as it moves longitudinally through various regions in the furnace, said furnace including a pair of elongated, longitudinally extending rails each having a top surface for supportingly engaging the bottom surface of the slab, characterized by said top surfaces being generally coplanar, each rail including a first and a second primary portion each laterally offset from one another for engaging, respectively, a first and second area of said bottom surface, each of the first primary portions being in a different region than that of the second primary portions, and heating means disposed vertically below said top surfaces for selectively heating the second areas when the slab is moved from supporting engagement by the second primary portions and has its first areas supported by the first primary portions.

19. A steel reheating furnace characterized by a plurality of elongated, longitudinally extending, heating elements and associated skid rails, each rail having laterally offset primary portions with each portion supporting either a respective first or second area on the bottom of a slab as it passes through the furnace, the areas being side-by-side, the heating elements directing their heat at the associated first area when the second area is supported by the associated rail portion, whereby to eliminate skid marks caused by rail portions otherwise shielding the slab from heat in the furnace.

20. A furnace for heating a steel slab as it moves through the furnace between an inlet to an outlet, said furnace including a pair of elongated, longitudinally extending rails each having a top surface for supportingly engaging the bottom surface of the slab, characterized by each rail including a first, second and third portion, the first and third portions being proximate, respectively, to the outlet and the inlet for engaging a first area of its slab and the second portions being laterally offset from its first and third portions for engaging a second area of its slab, first heating means adjacent to the second portions for actively heating said first areas to prevent heat sink formation caused by said first areas being supported by said third portions and second heating means adjacent to the outlet for actively heating said second areas to eliminate heat sink formation on said second areas caused when second areas were supported by said second portions.

21. The furnace as recited in claim 20 wherein there are four rails disposed in side-by-side relation, each being generally in a common horizontal plane and said heating means are disposed in a horizontal plane.

22. The furnace as recited in claim 20 wherein the first heating means and the second portions are disposed in a first vertical plane and the second heating means and the first and third portions are disposed in a second vertical plane, the vertical planes parallel to one another.

23. An elongated furnace chamber through which a slab to be heated is fed in a feeding direction and supported by at least one rail, characterized by a radially apertured pipe having a central bore which defines a pressurizable chamber for combustible gases, said rail having an elongated first portion overlying the pipe and an elongated second portion, each said portion for supporting laterally offset first and second areas on the bottom of the slab as the slab is moved between successive areas in the furnace, means for supplying and mixing natural gas and air to form a combustible gas mixture in the chamber, and ignition means for igniting the combustible gas mixture, the products of combustion being discharged from the slots and directed at the first areas when the second portions support the second areas.

* * * * *